US005816210A

United States Patent [19]

Yamaguchi

[11] Patent Number: 5,816,210

[45] Date of Patent: Oct. 6, 1998

[54] STRUCTURE OF AN EXHAUST PORT IN AN INTERNAL COMBUSTION ENGINE

[75] Inventor: Yuji Yamaguchi, Ageo, Japan

[73] Assignee: Nissan Diesel Motor Co., Ltd., Saitama-ken, Japan

[21] Appl. No.: 819,635

[22] Filed: Mar. 17, 1997

[30] Foreign Application Priority Data

Oct. 3, 1996 [JP] Japan ..... 8-262958

[51] Int. Cl.[6] ..... F02F 1/42

[52] U.S. Cl. ..... 123/188.14; 123/193.5

[58] Field of Search ..... 123/193.5, 188.14, 123/188.7, 188.8, 188.9; 60/272

[56] References Cited

U.S. PATENT DOCUMENTS 4,095,578 6/1978 Allara et al. ..... 123/188.14
4,228,653 10/1980 Sperry ..... 123/188.14
4,302,935 12/1981 Cousimano ..... 60/272
4,537,028 8/1985 Humke ..... 60/272
4,606,308 8/1986 Furlong ..... 123/188.14
4,694,646 9/1987 Holmstrom ..... 60/272
5,081,965 1/1992 Walters et al. ..... 123/188.14

*Primary Examiner*—Erick R. Solis
*Attorney, Agent, or Firm*—Armstrong, Westerman, Hattori, McLeland & Naughton

[57] ABSTRACT

A structure of an exhaust port (2) in an internal combustion engine is provided, which is capable of increasing the flow in the exhaust port (2) by regulating the flow of exhausted gases produced around a valve stem (4*a*). In the exhaust port (2) formed in a cylinder head (1), which has therein a boss (7) inserted with a valve guide (5) supporting a valve stem (4*a*) of an exhaust valve (4), a projection (3) is extended from the boss (7) of the valve guide (5) toward an opening port (P) and projects into the exhaust port (2). The projection (3) is provided on an exhaust-port wall (2*a*) opposite of an exhaust exit-port (E) about the valve stem (4*a*).

14 Claims, 7 Drawing Sheets

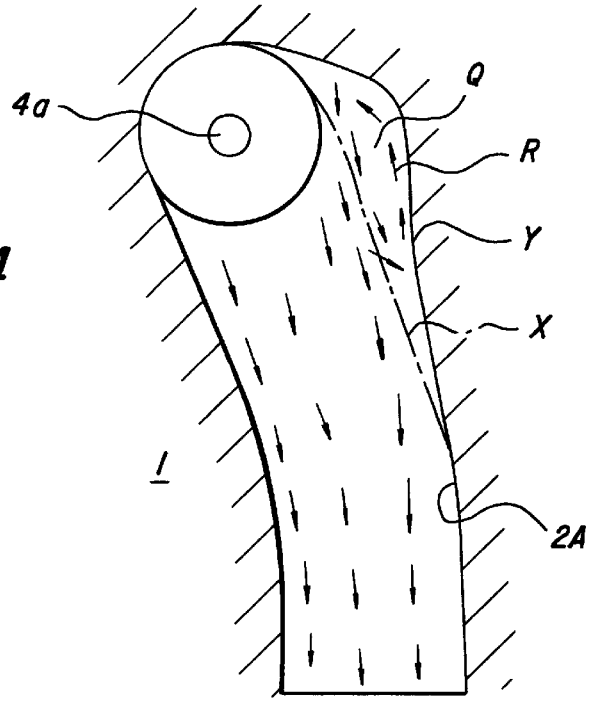
FIG.14
PRIOR ART
FIG.15
PRIOR ART
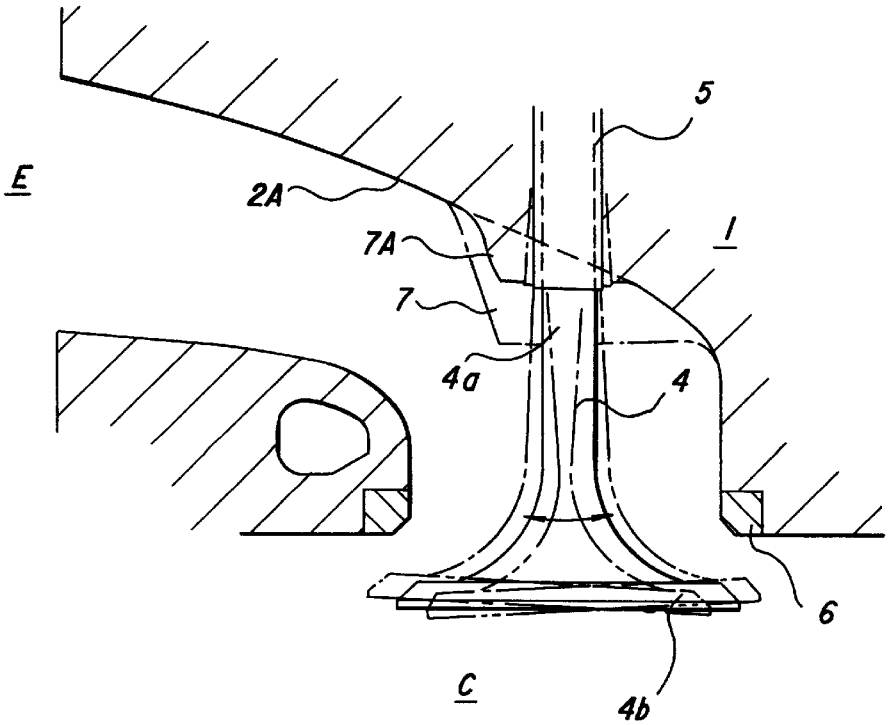

STRUCTURE OF AN EXHAUST PORT IN AN INTERNAL COMBUSTION ENGINE

BACKGROUND OF THE INVENTION

1. Field of the Invention

The present invention relates generally to a structure of an exhaust port in an internal combustion engine, and more particularly, to a structure of an exhaust port in an internal combustion engine in which the exhaust port is formed in a cylinder head which includes therein a boss that is inserted with a valve guide supporting a valve stem of an exhaust valve.

2. Description of Related Art

In order to increase the flow rate of exhaust gas in an exhaust port of an internal combustion engine, conventional methods for either enlarging the cross-sectional area of a flow path in the vicinity of a valve stem or for forming a smaller boss to be inserted with the valve stem have been used.

Referring to FIG. 14, the above-mentioned conventional method of enlarging the cross-sectional area of a flow path in the vicinity of a valve stem 4*a* is illustrated. When the shape of an exhaust port 2A in a cylinder head 1 is enlarged from the shape illustrated by line X, having alternating long and short dashes, to the shape illustrated by a solid line Y, a circulating flow of the exhausted gases R as illustrated by arrows, is produced in the enlarged portion Q. The enlarged portion Q does not increase the flow rate. Since the width of a channel of cooling water is narrowed by a projection across the port which results in an inhibition of the amount of flow of the cooling water, the effects of the above-mentioned conventional methods are known to disadvantageously affect cooling.

Referring to FIG. 15, the above-mentioned conventional method of forming a smaller boss 7A to be inserted with the valve stem 4*a* is illustrated. When the shape of the boss 7A, which is inserted with the valve guide 5, is formed to be of a smaller size (i.e., from the shape 7 bounded by a line having alternatingly long and short dashes to the shape bounded by the solid line), the flow rate of the exhaust gas from the exhaust port 2A is increased. The smaller shape of the boss 7A results in a shortening of the length necessary to support the valve guide 5. Thus, the valve guide 5 is collapsed as illustrated by the line having alternatingly long and short dashes and by the line having two short dashes alternating with one long dash. The collapse of the valve guide 5 causes an unbalanced wear to be produced on the valve 4, the valve guide 5 and the valve seat 6. The unbalanced wear produces a disadvantage in endurance and reliability. Therefore, the use of the above-mentioned conventional methods (i.e., either enlarging the flow path cross-sectional area in the vicinity of the valve stem 4*a* or forming a smaller boss 7A to be inserted with the valve stem 4*a*) is problematic, especially for a heavy duty diesel engine.

SUMMARY OF THE INVENTION

According to the present invention, a structure of an exhaust port in an internal combustion engine, the exhaust port being formed in a cylinder head including therein a boss inserted with a valve guide supporting a valve stem of an exhaust valve, includes a projection provided on an exhaust-port wall, opposite to an exhaust exit-port about the boss inserted with the valve guide, to be extended from the boss inserted with the valve guide toward an opening port and project into the exhaust port.

A structure of an exhaust port in an internal combustion engine, the exhaust port being formed in a cylinder head to have therein a boss inserted with a valve guide supporting a valve stem of an exhaust valve, includes a projection provided under the boss inserted with the valve guide to be extended from the vicinity of an outer wall of the valve guide toward the side opposite to an exhaust exit-port from the center of the valve guide in a radial direction and to project into the exhaust port.

The projection may have a triangular shaped, a semi-circular shaped, a trapezoidal shaped or a quadrangularly shaped cross-section and the projection may have the substantially same cross-sectional shape from one end of the projection to the other. Furthermore, the projection may have substantially similar figures from one end of the projection to the other, in which the cross-sectional area becomes gradually smaller from one end to another.

According to the present invention, in an exhausting process, the exhausted gases flowing from the opening port into the exhaust port flow along both sides of the valve stem by being divided in two by the projection formed on the exhaust-port wall, so that a stagnation point, produced upstream of the valve stem, or a vortex, produced downstream, is inhibited, resulting in the increase of the flow of the exhausted gases in the exhaust port.

BRIEF EXPLANATION OF THE DRAWING FIGURES

FIG. 14 is a cross-sectional view of the shape of a conventional port having an enlarged portion; and FIG. 15 is a cross-sectional view of the enlarged shape of a port in which a conventional boss of a valve guide is formed to be smaller.

EMBODIMENT OF THE INVENTION

Figure 1:
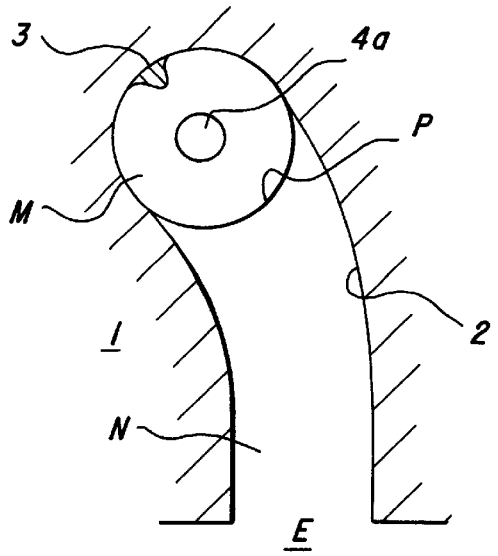
FIG. 1 is a cross-sectional view showing an embodiment according to the present invention.

The preferred embodiments according to the present invention will be explained below with reference to the attached drawing figures. The description of the following embodiments uses the same reference numerals to designate the same or similar components as those in the above-mentioned conventional art explained with reference to FIGS. 14 and 15 so that the description of the same or similar components will be omitted or simplified.

Figure 2:
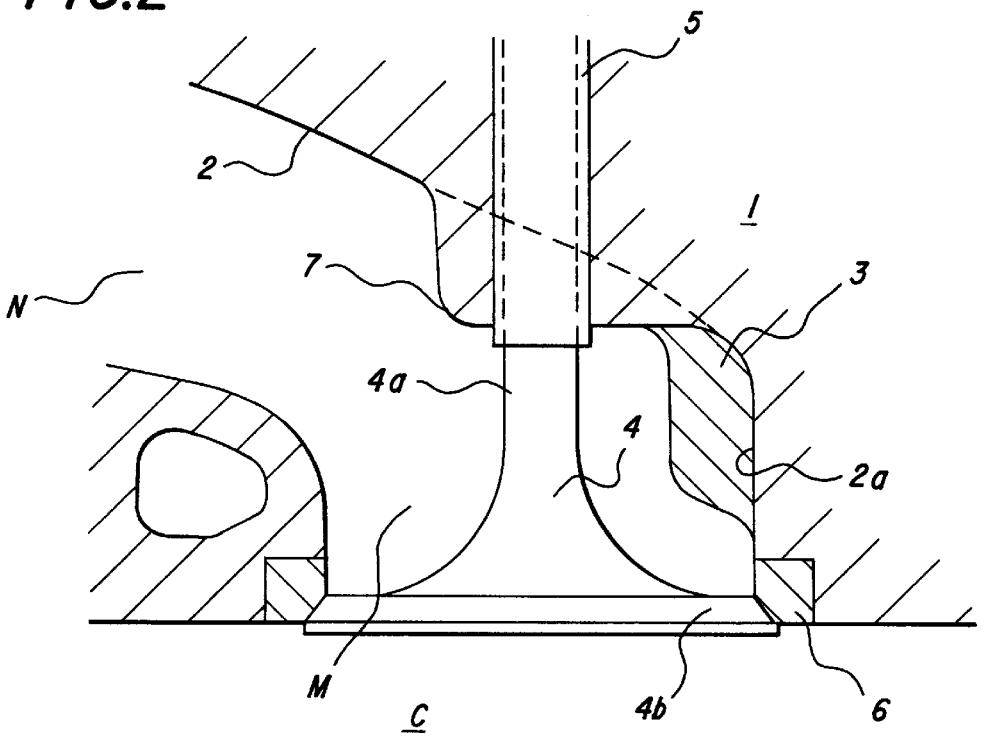
FIG. 2 is a side view of the cross-section of FIG. 1.

In FIGS. 1 and 2, an exhaust port 2 is formed in a cylinder head 1 to rise from an opening port P leading toward a combustion chamber C in a cylinder. The exhaust port 2 is composed of a first area M in which an exhaust valve 4 is provided to be passed through a valve stem 4*a*, and a second area N bending from the first area M to communicate with an exhaust exit-port E connected to an exhaust manifold. A boss 7 is projected into the exhaust port 2, and a valve guide 5 is inserted into the boss 7 to slidably support the valve stem 4*a* of the exhaust valve 4. A valve seat 6 is inlaid in a seating position of a valve head 4*b* of the above-mentioned exhaust valve 4 in the opening port P.

A projection 3 is provided on an exhaust-port wall 2*a* across from the valve stem 4*a* which is located in the first area M of the exhaust port 2, adjacent the exhaust exit-port E. The projection 3 is extended from the boss 7 of the valve guide 5 toward the opening port P and projects into the exhaust port 2.

Figure 3:
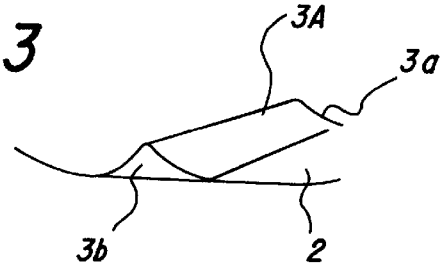
FIG. 3 is a perspective view showing a shape of a projection.
Figure 4:
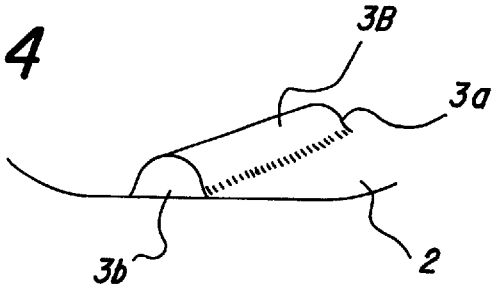
FIG. 4 is a perspective view showing another shape of a projection.
Figure 5:
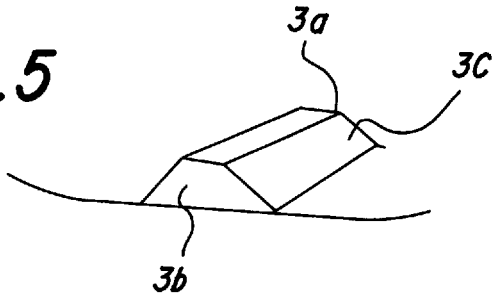
FIG. 5 is a perspective view showing still another shape of a projection.

FIGS. 3–5 show shapes of the projection 3. The projection 3 is of a uniform shape in which the width becomes gradually smaller from one end 3*a* of the opening port P to the other end 3*b*. Referring to FIG. 3, the projection 3A has a cross-sectional shape of a triangle with an acute ridge line. Referring to FIG. 4, the projection 3B has a cross-sectional shape of a semi-circle. Referring to FIG. 5, the projection 3C has a cross-sectional shape of a trapezoid.

Figure 6:
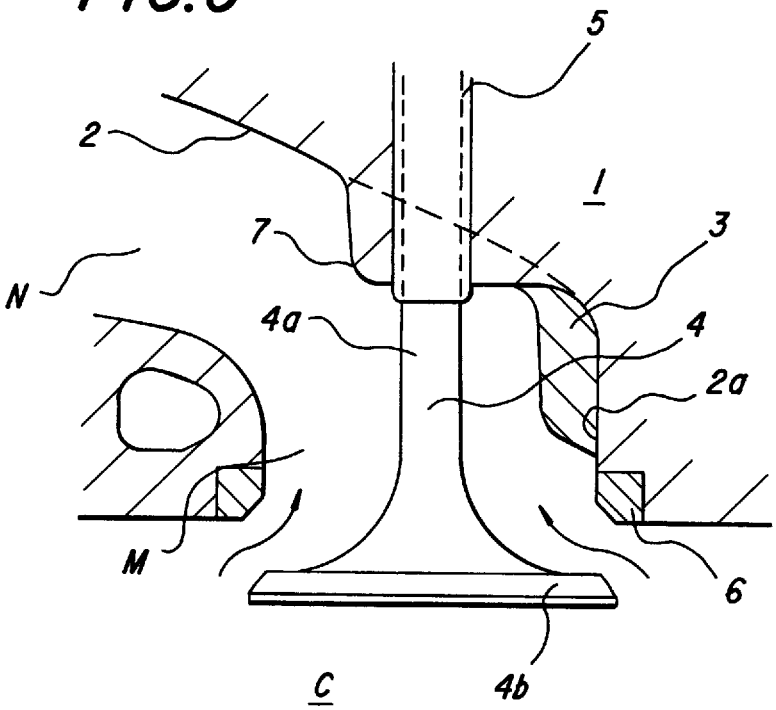
FIG. 6 is a cross-sectional view showing a position where the projection is provided.
Figure 7:
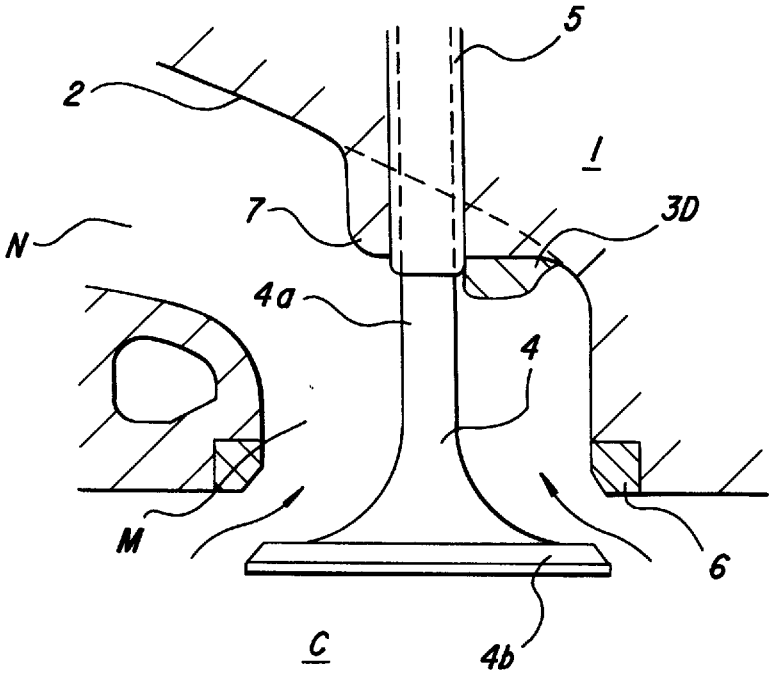
FIG. 7 is a cross-sectional view showing another position where the projection is provided.

The projection 3 is positioned on the wall 2*a* projecting outwardly from the opening port P in an example shown in FIG. 6. In an example shown in FIG. 7 the projection 3D is positioned under the boss 7 of the valve guide 5. In both examples shown in FIGS. 6 and 7, the projections are extended from the side opposite of the valve guide 5 from the exhaust exit-port E toward an upstream direction, namely, the opening port P.

Figure 8:
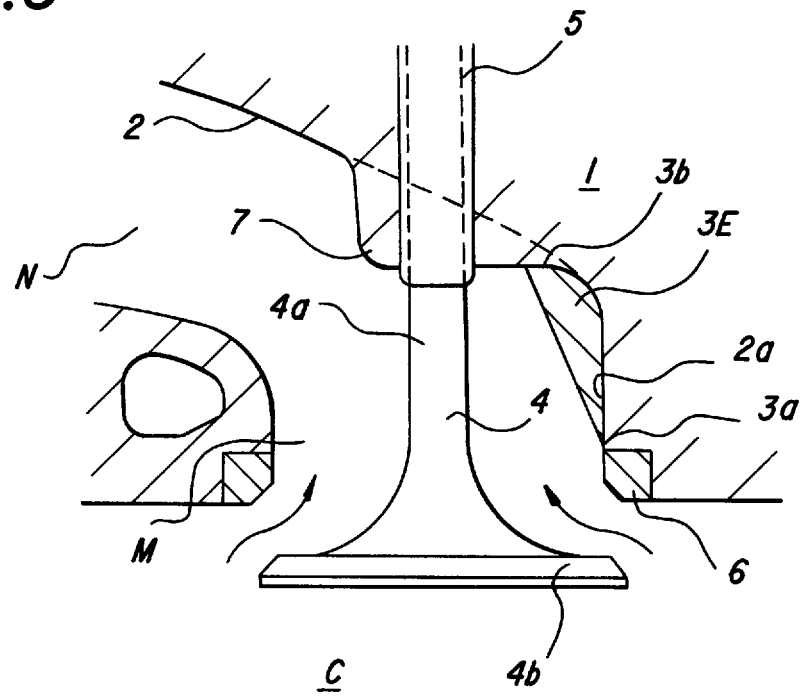
FIG. 8 is a cross-sectional view showing another embodiment according to the present invention.
Figure 9:
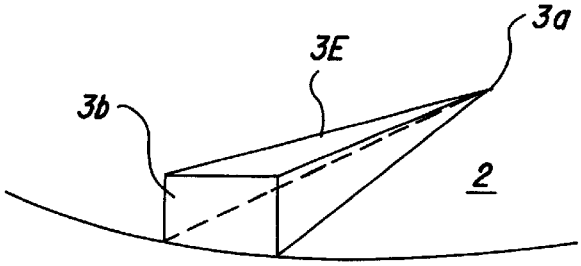
FIG. 9 is a perspective view of the projection shown in FIG. 8.

FIGS. 8 and 9 further show another embodiment according to the present invention, in which a projection 3E is formed to be a pyramidal shape as a whole to position the one end 3*a* of the projection in the vicinity of the valve seat 6 and the other end 3*b* on the boss 7 by extending upwardly from the one end 3*a*. As shown from FIG. 9, the sectional shape is substantially uniform, but becomes gradually smaller from the end 3*b* toward the end 3*a*.

Figure 11:
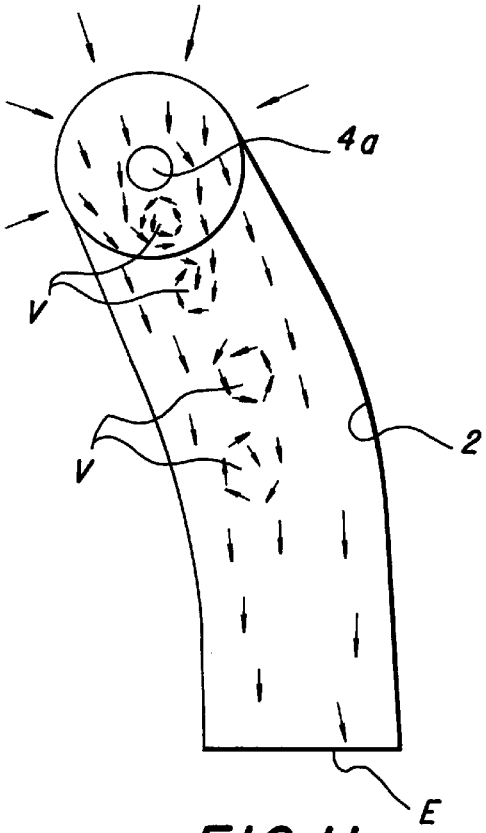
FIG.11 PRIOR ART
FIG. 11 is a cross-sectional view showing a conventional exhaust port in a flowing state.

In a conventional exhaust port not having a projection as shown in FIG. 11, the exhausting process proceeds as follows: the exhausted gases, which flow from the opening port P to the side opposite of the valve stem 4*a* from the exhaust exit-port E, are blown against the valve stem 4*a*. Thereby, a stagnation point is produced in the upstream side of the valve stem 4*a*. As a result, by increasing the pressure of the upstream side of the valve stem 4*a*, the flow of the exhausted gases into the first area M of the exhaust port 2 is inhibited. Furthermore, in the downstream side of the valve stem 4*a*, the occurrence of the burble of the flow causes a vortex V to be produced, resulting in the reduction of the effective flow gas cross-sectional area of the second area N of the exhaust port 2.

Figure 10:
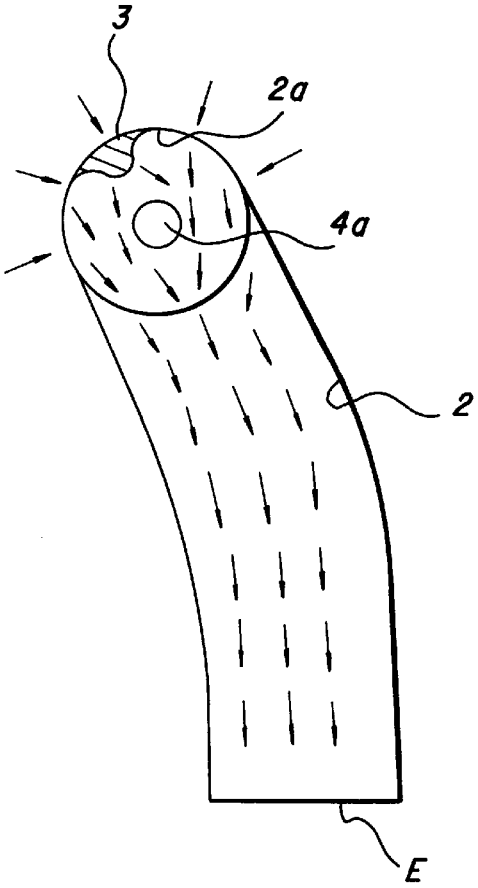
FIG. 10 is a cross-sectional view showing an exhaust port in a flowing state according to the present invention.

However, as shown in FIG. 10, by providing the projection 3 in the upstream side of the valve guide 5, the exhausted gases flowing into the other side of the valve stem 4*a* (the opposite side to the exhaust exit-port E) are divided into two flows by the projection 3. Flow along both sides of the valve stem 4*a* results in the orderly flow of the exhausted gases. Therefore, a high-pressure region of the upstream side of the valve stem 4*a* disappears so that the inhibition of the flow into the exhaust port 2 is stopped. Further, the vortex is not produced in the downstream side of the valve stem 4*a*, so that the effective flow gas cross-sectional area of the exhaust port 2 is approximately the same as the geometrical sectional area, resulting in the increase of the flow rate of exhausted gases in the exhaust port 2.

Figure 12:
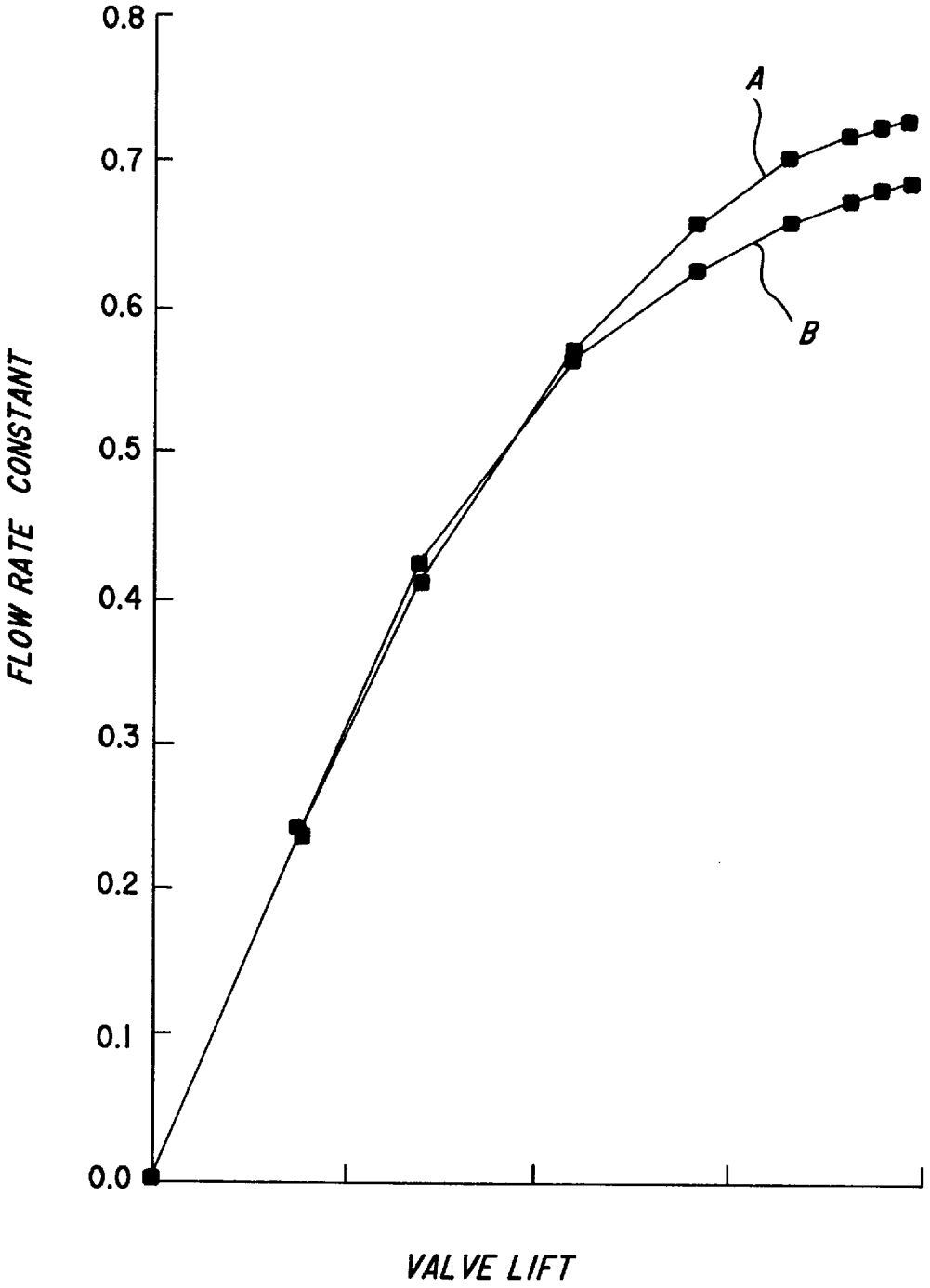
FIG. 12 is a graph showing the improvement of a flow rate coefficient according to the present invention.

FIG. 12 shows comparative data of the flow, determined by actual measurement, when the projection 3 is provided and when the projection 3 is not provided. More specifically, the vertical axis shows a flow rate coefficient as a ratio between a theoretical flow and a measured flow and the horizontal axis shows a valve lift, in which the exhaust port provided with the projection according to the present invention is illustrated with a sign A, and the conventional exhaust port without the projection is illustrated with a sign B. From the drawing, it is understood that the flow rate coefficient is improved by the projection. More particularly, the difference between the flow rate coefficients is increased as the valve lift is increased.

Figure 13:
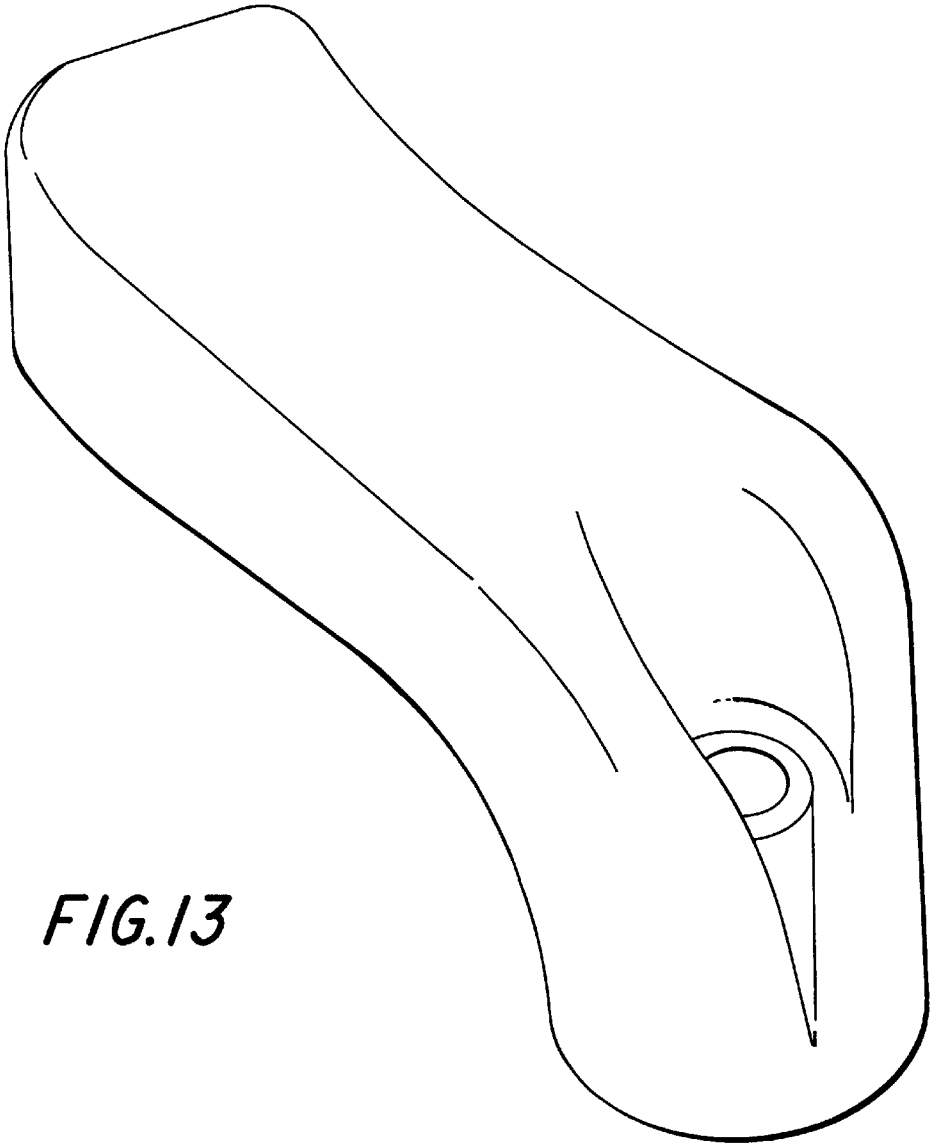
FIG. 13 shows a casting core used in the embodiments of the present invention.

FIG. 13 shows a casting core used in the embodiment of the present invention.

The present invention is structured as described above so that the following effects can be accomplished:

(1) by decreasing exhaust gas flow resistance in the exhaust port, workload of a pump in the exhausting process is decreased, resulting in the improvement of a fuel consumption rate and the increase of the output. The effect is further increased in a high-load and high-speed region where a high amount of exhausted gases are produced.

(2) the flow of the exhausted gases is increased, so that gas can be sufficiently exchanged even when the time for closing the exhaust valve is delayed, resulting in the improvement of thermal efficiency by increasing the effective expansion ratio.

The entire disclosure of Japanese Patent Application No. 8-262958 filed on Oct. 3, 1996 including the specification, the claims, the drawing figures and the summary are incorporated herein by reference in its entirety.

What is claimed is:

1. An exhaust port in a cylinder head of a large diesel internal combustion engine, said exhaust port comprising:

an opening at a first end of said exhaust port;

an exit at a second opposed end of said exhaust port, an approximately cylindrically-shaped side wall between said opening of said exhaust port and said opening of said exhaust port, wherein said side wall has an upper portion and a lower portion;

a first straight area adjacent to said opening of said exhaust port;

a second straight area adjacent to said exit of said exhaust port;

an intermediate area between said first straight area and said second straight area, wherein said exhaust port bends through said intermediate area to connect said first straight area to said second straight area such that said intermediate area has a bending point;

an exhaust valve having a valve stem extending from a valve guide, wherein said valve guide is partially located within said cylinder head above said upper portion of said side wall of said exhaust port;

a relatively large boss means for interfering with flow in said intermediate area of said exhaust port, wherein said boss means extends from said upper portion of said side wall into said intermediate area of said exhaust port, wherein said boss means is inserted with said valve guide supporting said valve stem of said exhaust valve and wherein said bending point of said intermediate area is located within said boss means;

a first plane tangent to a first section of said upper portion of said side wall, wherein said first section of said upper portion of said side wall is adjacent to said first straight area;

a second plane tangent to a second section of said upper portion of said side wall, wherein said second section of said upper portion of said side wall is adjacent to said second straight area, said second plane being parallel to a longitudinal axis of said valve stem, and said second plane intersecting said first plane so as to form an incline angle which is greater than 75 degrees;

a third plane through said boss means and including said bending point, wherein said third plane is perpendicular to said longitudinal axis of said valve stem, said third plane is parallel to a fourth plane containing a bottom wall of said boss means, and said third plane is perpendicular to a fifth plane containing a side wall of said boss means such that said bottom wall of said boss means and said side wall of said boss means meet at an edge portion such that said edge portion extends in series to said side wall of said boss means which is generally parallel to said longitudinal axis of said valve stem; and a projection provided on said upper portion of said side wall, opposite to said exit of said exhaust port about said boss means inserted with said valve guide, to be extended from said boss means inserted with said valve guide toward said opening of said exhaust port and project into said first straight area of said exhaust port.

2. An exhaust port in a cylinder head of a large diesel internal combustion engine, said exhaust port comprising:

an opening at a first end of said exhaust port;

an exit at a second opposed end of said exhaust port;

an approximately cylindrically-shaped side wall between said opening of said exhaust port and said opening of said exhaust port, wherein said side wall has an upper portion and a lower portion;

a first straight area adjacent to said opening of said exhaust port;

a second straight area adjacent to said exit of said exhaust port;

an intermediate area between said first straight area and said second straight area, wherein said exhaust port bends through said intermediate area to connect said first straight area to said second straight area such that said intermediate area has a bending point;

an exhaust valve having a valve stem extending from a valve guide, wherein said valve guide is partially located within said cylinder head above said upper portion of said side wall of said exhaust port;

a relatively large boss means for interfering with flow in said intermediate area of said exhaust port, wherein said boss means extends from said upper portion of said side wall into said intermediate area of said exhaust port, wherein said boss means is inserted with said valve guide supporting said valve stem of said exhaust valve and wherein said bending point of said intermediate area is located within said boss means;

a first plane tangent to a first section of said upper portion of said side wall, wherein said first section of said upper portion of said side wall is adjacent to said first straight area;

a second plane tangent to a second section of said upper portion of said side wall, wherein said second section of said upper portion of said side wall is adjacent to said second straight area, said second plane being parallel to a longitudinal axis of said valve stem, and said second plane intersecting said first plane so as to form an incline angle which is greater than 75 degrees;

a third plane through said boss means and including said bending point, wherein said third plane is perpendicular to said longitudinal axis of said valve stem, said third plane is parallel to a fourth plane containing a bottom wall of said boss means, and said third plane is perpendicular to a fifth plane containing a side wall of said boss means such that said bottom wall of said boss means and said side wall of said boss means meet at an edge portion such that said edge portion extends in series to said side wall of said boss means which is generally parallel to said longitudinal axis of said valve stem; and a projection, provided under said boss means which is inserted with said valve guide, wherein said projection extends from a vicinity of an outer wall of said valve guide toward said lower portion of said side wall opposite to said exit of said exhaust port from a center of said valve guide in a radial direction and to project into said exhaust port.

3. The structure of said exhaust port in said internal combustion engine according to any one of claims 1 and 2, wherein said projection has a triangular shaped cross-section.

4. The structure of said exhaust port in said internal combustion engine according to any one of claims 1 and 2, wherein said projection has a semi-circular shaped cross-section.

5. The structure of said exhaust port in said internal combustion engine according to any one of claims 1 and 2, wherein said projection has a trapezoidal shaped cross-section.

6. The structure of said exhaust port in said internal combustion engine according to any one of claims 1 and 2, wherein said projection has a quadrangular-shaped cross-section.

7. The structure of said exhaust port in said internal combustion engine according to claim 3, wherein said projection has a substantially uniform cross-sectional shape from a first end of said projection to a second end of said projection.

8. The structure of said exhaust port in said internal combustion engine according to claim 4, wherein said projection has a substantially uniform cross-sectional shape from a first end of said projection to a second end of said projection.

9. The structure of said exhaust port in said internal combustion engine according to claim 5, wherein said projection has a substantially uniform cross-sectional shape from a first end of said projection to a second end of said projection.

10. The structure of said exhaust port in said internal combustion engine according to claim 6, wherein said projection has a substantially uniform cross-sectional shape from a first end of said projection to a second end of said projection.

11. The structure of said exhaust port in said internal combustion engine according to claim 3, wherein said projection has a substantially uniform cross-sectional shape from a first end of said projection to a second end of said projection, but said cross-sectional shape becomes gradually smaller from said first end having a larger cross-sectional area toward said second end having a smaller cross-sectional area.

12. The structure of said exhaust port in said internal combustion engine according to claim 4, wherein said projection has a substantially uniform cross-sectional shape from a first end of said projection to a second end of said projection, but said cross-sectional shape becomes gradually smaller from said first end having a larger cross-sectional area toward said second end having a smaller cross-sectional area.

13. The structure of said exhaust port in said internal combustion engine according to claim 5, wherein said projection has a substantially uniform cross-sectional shape from a first end of said projection to a second end of said projection, but said cross-sectional shape becomes gradually smaller from said first end having a larger cross-sectional area toward said second end having a smaller cross-sectional area.

14. The structure of said exhaust port in said internal combustion engine according to claim 6, wherein said projection has a substantially uniform cross-sectional shape from a first end of said projection to a second end of said projection, but said cross-sectional shape becomes gradually smaller from said first end having a larger cross-sectional area toward said second end having a smaller cross-sectional area.

* * * * *